US007003822B1

(12) United States Patent
Sheehy

(10) Patent No.: US 7,003,822 B1
(45) Date of Patent: Feb. 28, 2006

(54) EXTRUDED KNOCK-DOWN PLASTIC BED FRAME ASSEMBLY

(75) Inventor: Gregory R Sheehy, Reedsville, WI (US)

(73) Assignee: Extrutech Plastics, Inc., Manitowoc ( * ) Notice: Subject to any disclaimer, the term of this patent is extended or adjusted under 35 U.S.C. 154(b) by 216 days.

(21) Appl. No.: 09/977,737

(22) Filed: Oct. 15, 2001

Related U.S. Application Data

(60) Provisional application No. 60/240,699, filed on Oct. 16, 2000.

(51) Int. Cl.
*A47C 19/00* (2006.01)

(52) U.S. Cl. ..... 5/201; 5/200.1; 5/400

(58) Field of Classification Search ..... 5/201, 5/200.1, 400, 186.1
See application file for complete search history.

(56) References Cited

U.S. PATENT DOCUMENTS 4,391,008 A * 7/1983 Yamaoka et al. ..... 5/200.1
4,507,815 A * 4/1985 Danko ..... 5/400
4,613,999 A * 9/1986 Franco et al. ..... 5/400
4,617,689 A * 10/1986 Nelson et al. ..... 5/400
4,646,371 A * 3/1987 Nowell ..... 5/200.1
4,718,132 A * 1/1988 Wirland ..... 5/400 X
4,734,946 A * 4/1988 Saputo ..... 5/400
5,070,556 A * 12/1991 Gloger ..... 5/400 X
5,099,529 A * 3/1992 Anderson ..... 5/400
5,144,706 A * 9/1992 Walker ..... 5/400
5,289,600 A * 3/1994 Schermel ..... 5/400
5,469,589 A * 11/1995 Steed et al. ..... 5/400
5,564,140 A * 10/1996 Shoenhair et al. ..... 5/400
5,953,775 A * 9/1999 Mauro et al. ..... 5/201
5,996,145 A * 12/1999 Taylor ..... 5/200.1
6,557,191 B1 * 5/2003 Bellows et al. ..... 5/200.1
6,832,397 B1 * 12/2004 Gaboury et al. ..... 5/201
6,883,191 B1 * 4/2005 Gaboury et al. ..... 5/201
2002/0069462 A1 * 6/2002 Gaboury et al. ..... 5/201
2003/0024045 A1 * 2/2003 Bellows et al. ..... 5/200.1
2003/0079284 A1 * 5/2003 Gaboury et al. ..... 5/201
2004/0078897 A1 * 4/2004 Gladney ..... 5/400
2004/0128761 A1 * 7/2004 Gaboury et al. ..... 5/400
2005/0028274 A1 * 2/2005 Hooper ..... 5/400
2005/0028275 A1 * 2/2005 Hooper ..... 5/400
2005/0034233 A1 * 2/2005 Gladney ..... 5/400
2005/0039259 A1 * 2/2005 Gladney ..... 5/400
2005/0120478 A1 * 6/2005 Hofmann ..... 5/400

FOREIGN PATENT DOCUMENTS

GB 2035078 A * 6/1980 ..... 5/200.1

* cited by examiner

*Primary Examiner*—Robert G. Santos
(74) *Attorney, Agent, or Firm*—Andrus, Sceales, Starke & Sawall, LLP

(57) ABSTRACT

A knock-down bed frame assembly formed from extruded plastic components. The knock-down bed frame assembly includes a frame having a pair of side rails and a pair of end rails joined together to define the rectangular peripheral edge of the bed frame. Both the side rails and the end rails are formed from sections of extruded plastic. The side rails are each formed from at least a pair of side boards connected to each other by a connector bracket, also formed from plastic. Each of the side rails includes a support section having a mounting slot that receives an end cap formed on each of a plurality of top panels. The top panels are mountable between the side rails to provide a support surface for a mattress. The entire knock-down bed frame can be disassembled into individual components that can be contained within a conventional shipping container.

14 Claims, 7 Drawing Sheets

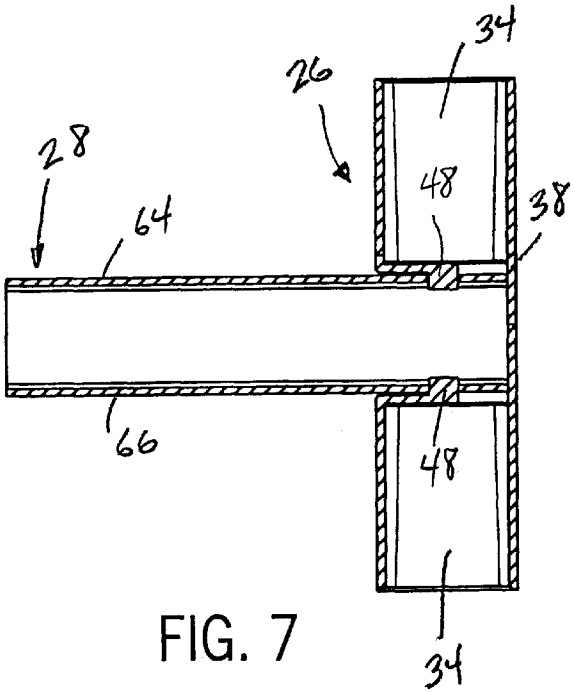
FIG. 7
FIG. 6
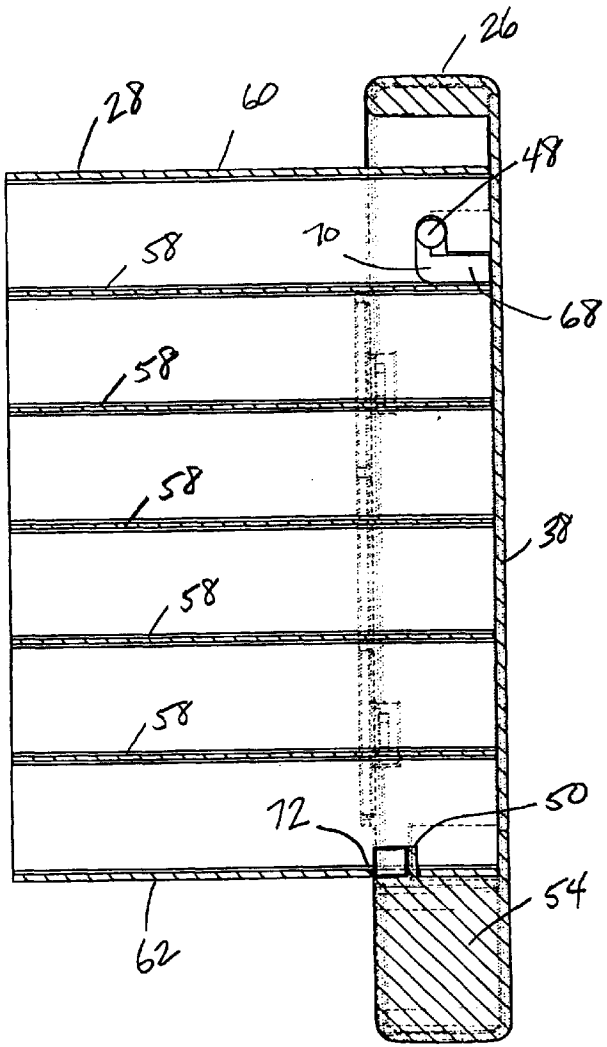

EXTRUDED KNOCK-DOWN PLASTIC BED FRAME ASSEMBLY

CROSS REFERENCE TO RELATED APPLICATION

The present invention is based on and claims priority to U.S. Provisional Patent application Ser. No. 60/240,699, filed Oct. 16, 2000.

BACKGROUND OF THE INVENTION

The present invention generally relates to a bed frame used to support a mattress. More specifically, the present invention relates to a knockdown bed frame formed from extruded plastic components that can be quickly assembled and can be collapsed into a relatively small package for shipment by mail.

Recently, air mattresses have become a more popular alternative to a conventional coil spring mattress. One distinct advantage of an air mattress is the ability of the air mattress to be deflated and collapsed into a relatively small package for storage and/or transportation. Air mattresses are particularly convenient for persons who move from place to place and do not want to transport a conventional mattress during these moves.

Air mattresses are typically supported on either a conventional box spring or upon a collapsible bed frame formed from metal or wood. A collapsible bed frame is particularly desirable since the user can disassemble both the bed frame and the air mattress for transportation and storage. However, currently available bed frames are both heavy and cumbersome to assemble and disassemble. Furthermore, the size of the collapsible bed frames makes shipment of the bed frames through conventional package delivery services, such as UPS, nearly impossible.

Therefore, a need exists for a knock-down bed frame that is lightweight and can be shipped by a conventional freight carrier. It is a further object of the invention to provide a bed frame that can be assembled and disassembled without the use of any tools. Further, it is an object of the present invention to provide a bed frame that is sturdy enough to support the weight of the user while being lightweight to facilitate transportation and set-up of the frame.

SUMMARY OF THE INVENTION

The present invention is a knock-down bed frame assembly that is formed from extruded plastic components and can be assembled/disassembled without the use of any external tools. The bed frame assembly includes a bed frame having a pair of side rails and a pair of end rails that are joined together to define the rectangular outer peripheral edge of the bed frame. Both the side rails and the end rails are formed from sections of extruded plastic material.

The support frame receives a plurality of spaced top panels that extend between and are supported by the spaced side rails. Each of the top panels is formed from a section of extruded plastic material. Each of the top panels receives a pair of caps on its spaced outer ends. Each of the end caps is a molded plastic component that includes a bottom ridge that is received within a mounting slot formed as part of the extruded side rail.

The side rails of the bed frame are formed from two separate side boards joined together by a connector bracket. Each of the connector brackets is a molded plastic component that receives one end of each side board of the side rail. Each of the side rails is joined to one of the end rails by a bracket assembly to form the corners of the bed frame.

The connector brackets used to form each side rail receive one end of a center beam that extends between the spaced side rails. The center beam is retained within each of the connector brackets by a mounting tab formed in the connector bracket that is received within the bottom wall of the center beam. The center beam that extends between the spaced side rails is formed from extruded plastic. The connector brackets further include a pair of locking pins that are received within grooves formed in the center beam to further aid in holding the center beam in place.

The bed frame includes a plurality of joists that extend between the center beam and the pair of end rails to provide further stability for the bed frame. Each of the joists is formed from extruded plastic and is supported at each end by a hanger. Each hanger is formed from molded plastic and includes a pair of protruding tabs that are received within aligned hanger notches formed in either the face surface of the center beam or the face surface of the end rail. The hanger includes a mounting tab protruding from its bottom wall that is received within a corresponding knockout formed in the bottom wall of the joist received by the hanger. In this manner, the hanger secures the joist in the desired position.

Each of the side boards that form the side rail and the pair of end rails includes an integrally formed support section that extends into the open interior defined by the bed frame. The support section includes a mounting slot that is formed to receive the bottom ridge of the end cap for each top panel such that the top panels can be supported between the side rails.

As described above, the entire knock-down bed frame of the present invention is formed from extruded plastic beams and molded plastic side connectors and hangers. The entire bed frame can be assembled/disassembled in a short period of time and is lightweight. The bed frame of the present invention can be taken apart and packaged in a container that can be shipped by UPS.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 6 is a section view illustrating the locking interconnection between the center beam and the connector bracket;

FIG. 7 is a top, section view taken along line 7—7 of FIG. 4 illustrating the connection between the connector bracket and the center beam;

DETAILED DESCRIPTION OF THE INVENTION

Figure 1:
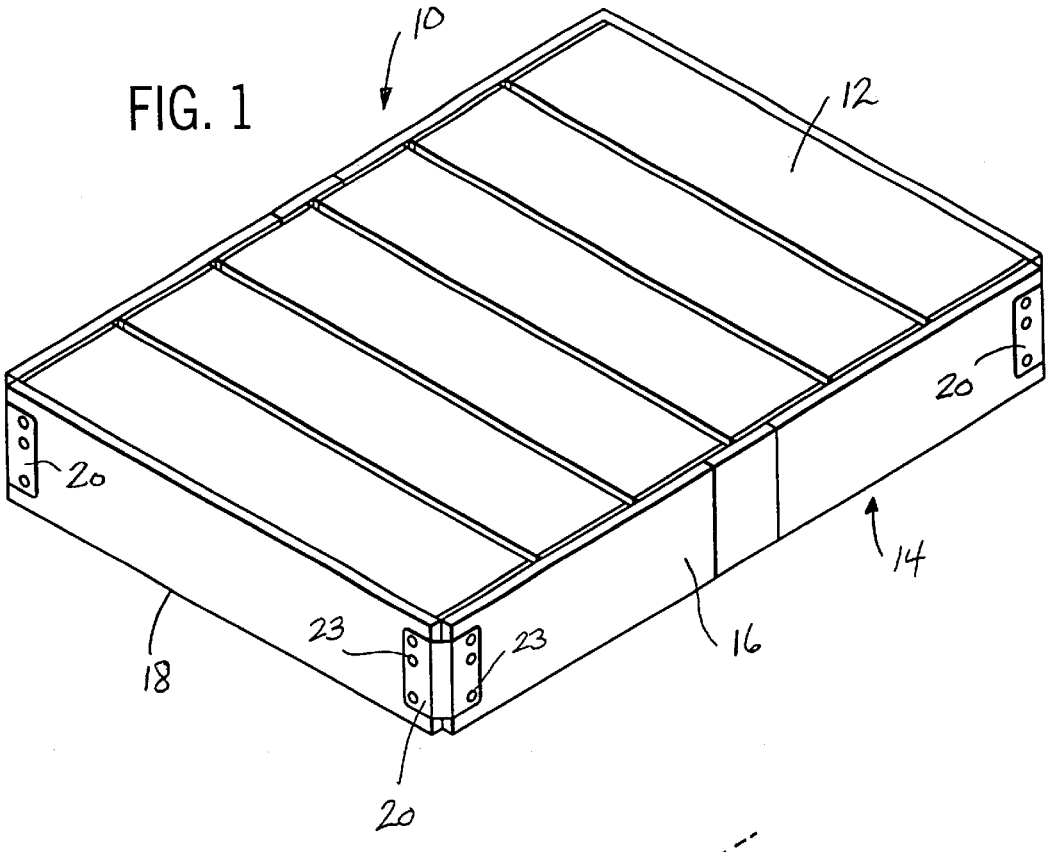
FIG. 1 is a perspective view illustrating the knock-down bed frame assembly of the present invention in its completely assembled form.

Referring first to FIG. 1, thereshown is the knock-down bed frame assembly 10 of the present invention. The bed frame assembly 10 can be configured in different sizes to support either a full size, queen size or king size mattress. The bed frame assembly 10 is particularly useful in supporting an air mattress, although the bed frame assembly 10 can also be used to support a conventional inner spring mattress.

The bed frame assembly 10 is formed almost entirely from extruded plastic components, which make the bed frame assembly 10 both lightweight and durable. The bed frame assembly 10 includes a plurality of spaced top panels 12 that are supported by a bed frame 14. The bed frame 14 is a rectangular structure formed by a pair of spaced side rails 16 and a pair of spaced end rails 18.

Figure 2:
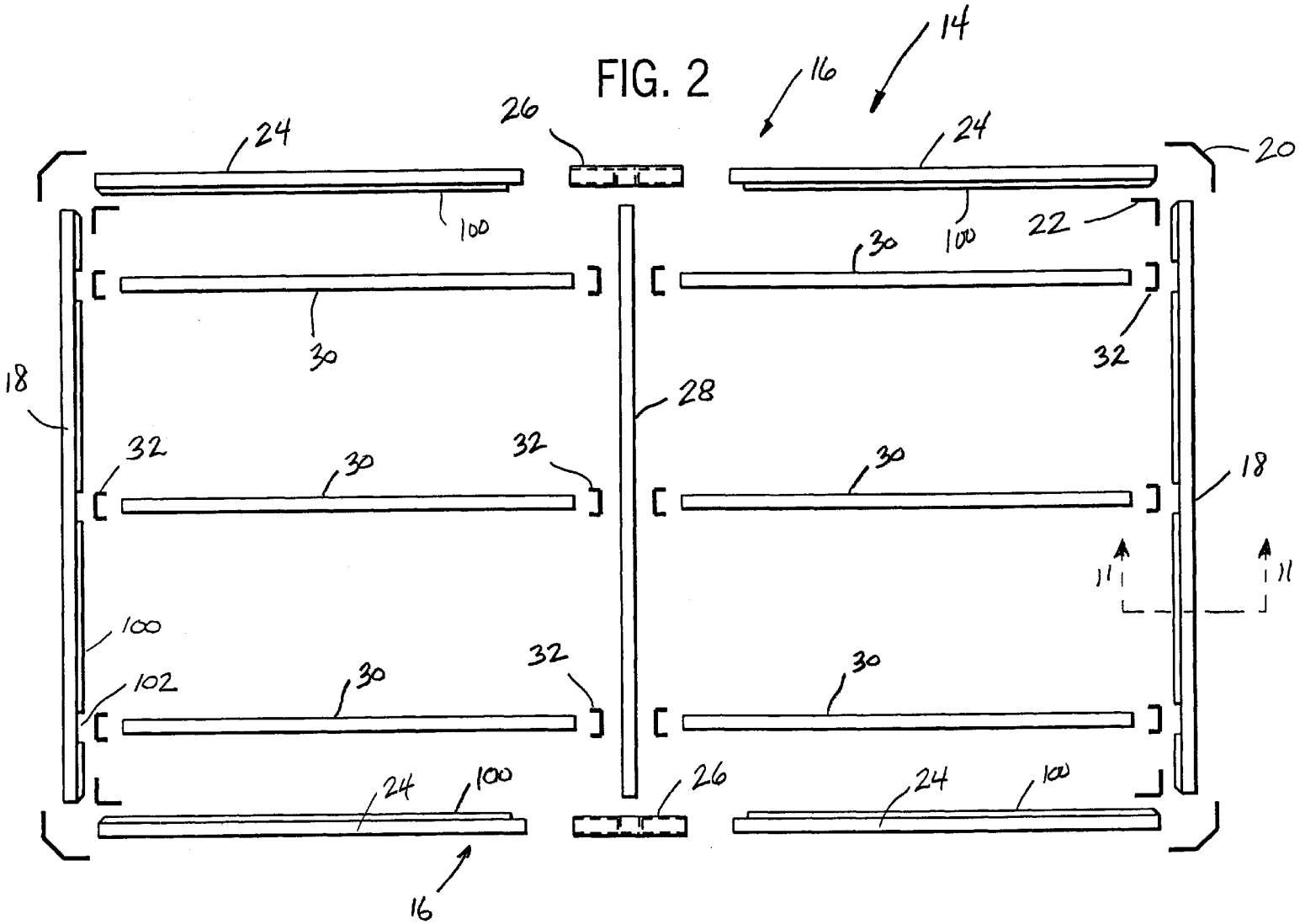
FIG. 2 is an exploded top view of the bed frame assembly with the top panels removed.

As illustrated in FIG. 1, the side rails 16 are joined to the end rails 18 by a corner bracket 20. As illustrated in FIGS. 1 and 2, the outer corner bracket 20 is connected to an inside bracket 22 by a plurality of bolts 23 that pass through the side rails 16 or the end rail 18 to securely join each side rail 16 to one of the end rails 18. When the bed frame 14 is assembled as shown in FIG. 1, the top panels 12 are supported between the side rails 16 to define a generally flat top surface that can be used to support a mattress.

Referring now to FIG. 2, each of the side rails 16 is formed from a pair of side boards 24 joined to each other by a connector bracket 26. The connector bracket 26 provides for secure attachment between the pair of side boards 24 while allowing the side boards 24 to be separated from each other for shipment or storage. As discussed previously, an advantage of the bed frame assembly 10 of the present invention is the ability to ship the entire bed frame assembly 10 in a conventional freight carrier package. Thus, the three piece assembly of each side rail 16 allows the bed frame assembly to be broken down and shipped via a standard freight carrier, such as UPS.

As shown in FIG. 2, each of the end rails 18 is formed from a single, continuous section of extruded plastic. However, if the width of the bed frame 14 were increased, each of the end rails 18 could be formed from a pair of end boards joined by one of the connector brackets. However, in the embodiment of the invention illustrated in FIG. 2, each of the end rails 18 is of a length that can fit into a conventional freight carton.

As illustrated in FIG. 2, the bed frame 14 includes a center beam 28 that extends across the rectangular, open interior of the bed frame between the pair of spaced connector brackets 26. The center beam 28 provides additional stability for the pair of spaced side rails 16.

The bed frame 14 includes a plurality of joists 30 that each extend between the center beam 28 and one of the end rails 18. The joists 30 provide support not only for the frame 14, but also for the series of top panels 12 mounted across the bed frame 14 between the pair of side rails 16.

As will be described in greater detail below, each of the joists 30 are supported between one of the end rails 18 and the center beam 28 by a pair of hangers 32. The hangers 32 are preferably formed from molded plastic and provide a secure point of attachment for each of the joists 30 between the center beam 28 and one of the end rails 18.

As illustrated in FIG. 2, the entire bed frame 14 can be assembled and disassembled into a number of individual components that will each fit within a standard UPS shipping container. As will be described in greater detail below, during assembly of the bed frame, a minimum number of tools are required to assemble and disassemble the bed frame 14.

Figure 3:
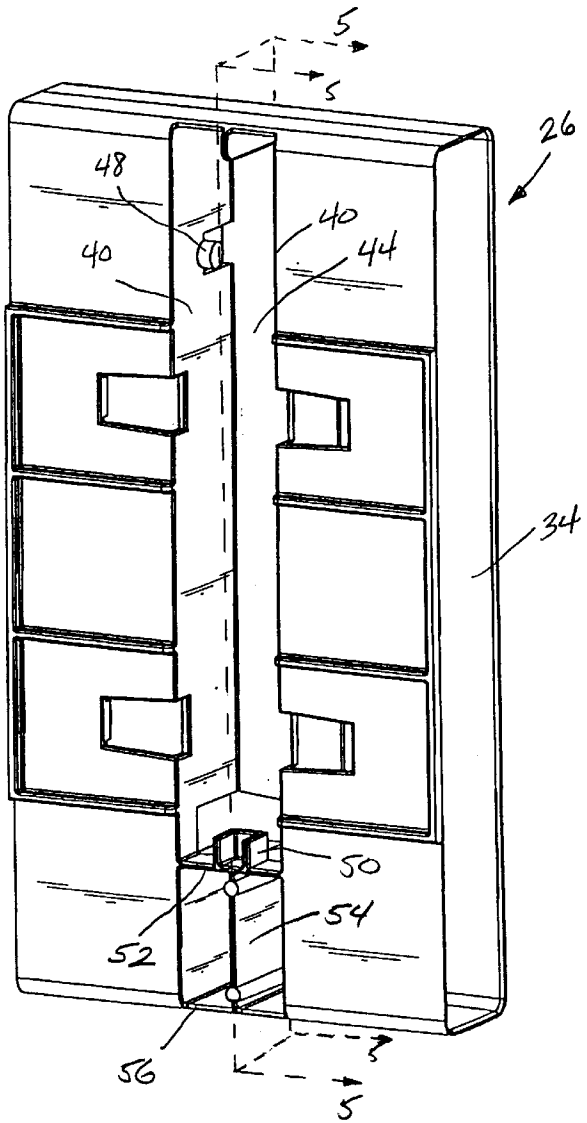
FIG. 3 is a perspective view illustrating a connector bracket used to form the side rails of the bed frame.
Figure 4:
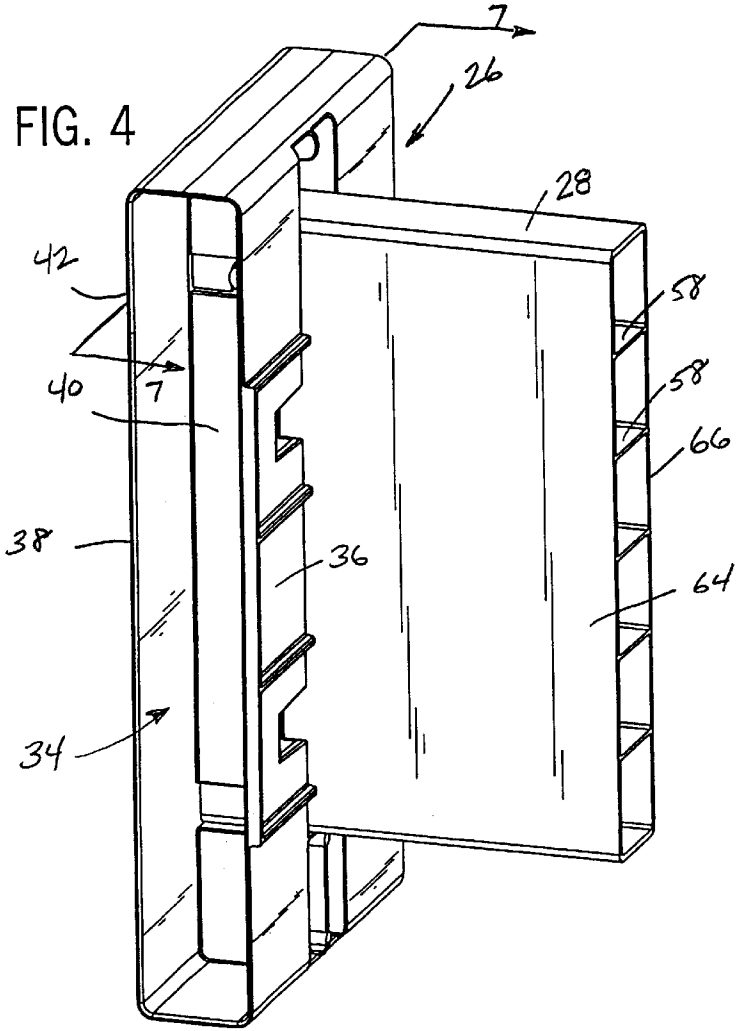
FIG. 4 is a perspective view illustrating the receipt of the center beam within the connector bracket shown in FIG. 3.
Figure 5:
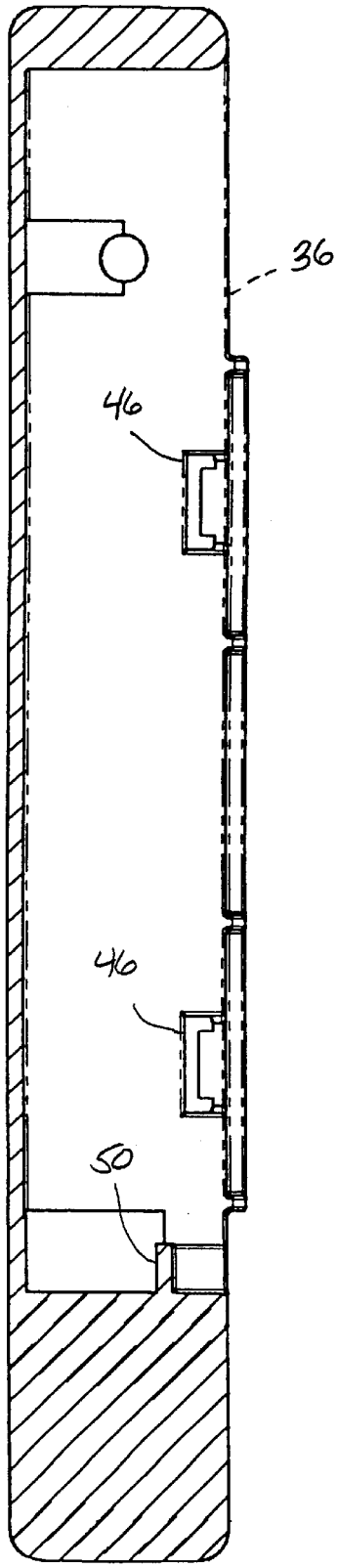
FIG. 5 is a section view taken along line 5—5 of FIG. 3.

FIGS. 3–5 illustrate the connector bracket 26 that is used to join the pair of side boards 24 and receive one end of the center beam 28. The connector bracket 26 includes a pair of opposed side openings 34 that are sized to receive one end of the respective side board 24 such that the connector bracket 26 joins the pair of side boards 24 to form the side rail 16.

As can be seen in FIG. 4, each of the side openings 34 is formed between the front wall 36 and the rear wall 38 of the connector bracket 26. The depth of each side opening 34 is defined by a back wall 40 that is spaced inwardly from the outer edge surface 42. The back wall 40 contacts the end of the respective side board when the side board is inserted into the side opening 34. As can be seen in FIG. 3, the pair of back walls 40 define a center channel 44. The center channel 44 is sized to receive the center beam 28, as illustrated in FIG. 4.

Referring now to FIG. 5, the front wall 36 of the connector bracket 26 includes a pair of locking tabs 46 that extend into the open interior of each side opening 34. The locking tabs 46 are each received within a corresponding notch formed in the front face surface of the side board 24 such that the side board 24 can be locked in place within the side opening 34. To release the side board 24, the outer edge surface 42 of the front wall 36 is pulled away from the side board, which releases the pair of locking tabs 46 from the side board. As can be understood by the above description, the attachment of the connector bracket 26 to each of the side boards 24 is accomplished by simply inserting the end of the side board into the connector bracket 26, as illustrated in FIG. 2. As the side board 24 is inserted into the connector bracket 26, the resilient nature of the plastic connector bracket 26 allows the pair of locking tabs 46 to be received in corresponding notches (not shown) formed in the side board 24. The interaction between the locking tabs 46 and the notches formed in the side board securely holds the side board in place relative to the connector bracket 26.

Referring back to FIG. 3, the center channel 44 of the connector bracket 26 includes a pair of locking pins 48 positioned on opposite sides of the center channel 44. Each of the locking pins 48 extends from the generally planar surface of the back wall 40 into the open center channel 44.

In addition to the locking pins 48, the center channel 44 includes a mounting tab 50 that extends upward from a bottom wall 52. The bottom wall 52 is supported by a support wall 54 that extends and is joined to the bottom wall 56 of the connector bracket 26.

Referring now to FIG. 6, thereshown is a section view of the center beam 28 securely mounted within the connector bracket 26. As can be seen in this Figure, the center beam 28 has a plurality of internal support walls 58 equally spaced between the top wall 60 and the bottom wall 62. The support walls 58 provide adequate support for the front face wall 64 and the back face wall 66 of the center beam 28, as shown in FIG. 7. Since the center beam 28 is an extruded plastic component, the support walls 58 are required to provide the adequate support for each of the face walls 64 and 66.

Referring back to FIG. 6, the end of the center beam 28 is inserted into the connector bracket 26 by tipping the opposite end of the illustrated center beam 28 upward and inserting the pair of locking pins 48 into a pair of receiving slots 68 formed in each of the respective face surfaces of the center beam 28. The center beam 28 is moved forward until the locking pin 48 reaches the corner 70 of the receiving slot 68. Once the locking pin 48 reaches the corner 70, the opposite end of the center beam 28 is dropped down until the mounting tab 50 enters into corresponding notch 72 formed in the bottom wall 62 of the center beam 28. The combination of the locking pins 48 and the mounting tab 50 hold the center beam 28 securely in place relative to the connector bracket 26.

As can be seen in FIG. 7, the pair of locking pins 48 interact with the center beam 28 to help hold the center beam 28 in proper alignment with the mounting bracket 26.

In addition to the center beam 28, the bed frame 14 includes the plurality of joists 30 to provide proper support for the top panels 12, as shown in FIG. 2. As previously described, each of the joists 30 are supported between the center beam 28 and one of the end rails 18 by a pair of hangers 32. The hangers 32 are required since the end rails 18 and the center beam 28 are extruded components that do not include any protruding structure that could support the joists 30.

Figure 8:
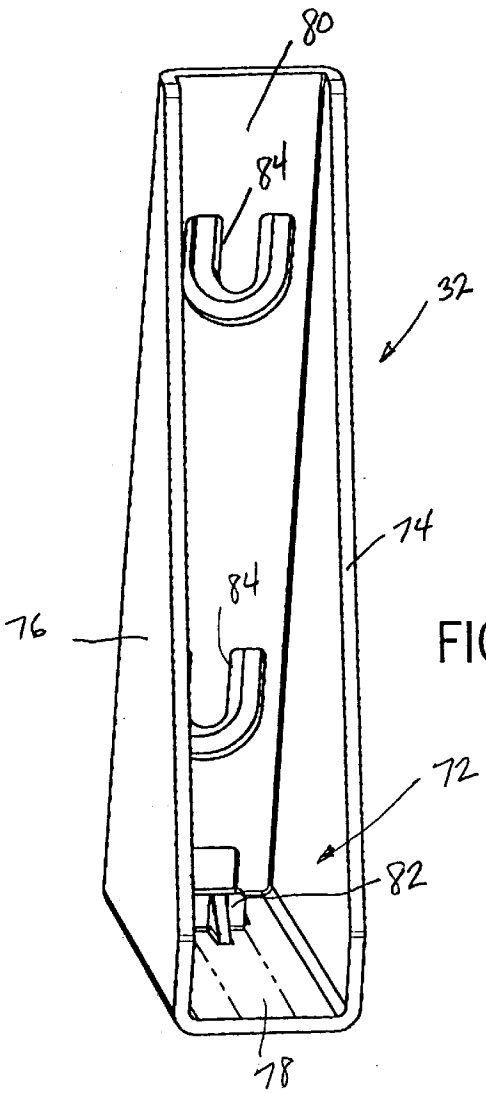
FIG. 8 is a front, perspective view of a hanger used to support the joists between the center beam and the end rails.

Referring now to FIG. 8, thereshown is the hanger 32 used in accordance with the present invention. The hanger 32 generally includes an open interior 72 defined by a pair of angled sidewalls 74 and 76, a bottom wall 78, and a back wall 80. In the preferred embodiment of the invention, the entire hanger 32 is formed from molded plastic.

The open interior 72 of the hanger 32 is sized to receive one end of a joist 30. The joist 30 is inserted into the open interior 72 and is held in place by an extended tab 82 formed in the bottom wall 78. As can best be seen in FIG. 9, the extended tab 82 protrudes from the bottom wall 78 and is spaced inwardly from the back wall 80. Although not shown, the extended tab 82 is received within a knock-out formed in the bottom wall of the joist 30 being supported by the hanger 32. The extended tab 82 prevents the joist 30 from sliding outward relative to the hanger 32.

Figure 9:
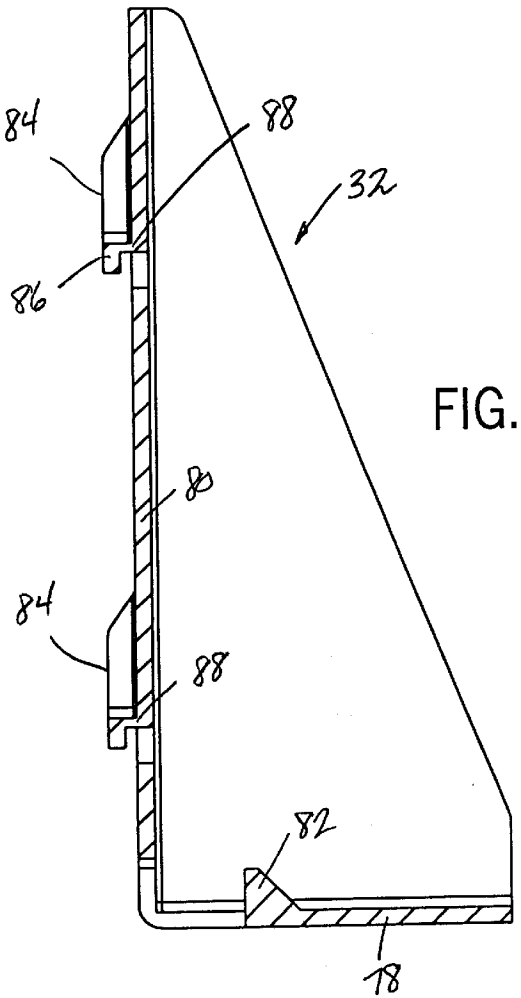
FIG. 9 is a section view of the hanger shown in FIG. 8.

As can be seen in FIG. 9, the back wall 80 of the hanger includes a pair of U-shaped mounting tabs 84 that extend from the outer surface of the back wall 80. Each of the mounting tabs 84 is defined by a protruding lower edge 86 that is spaced from the back wall 80 by a standoff 88.

Figure 10:
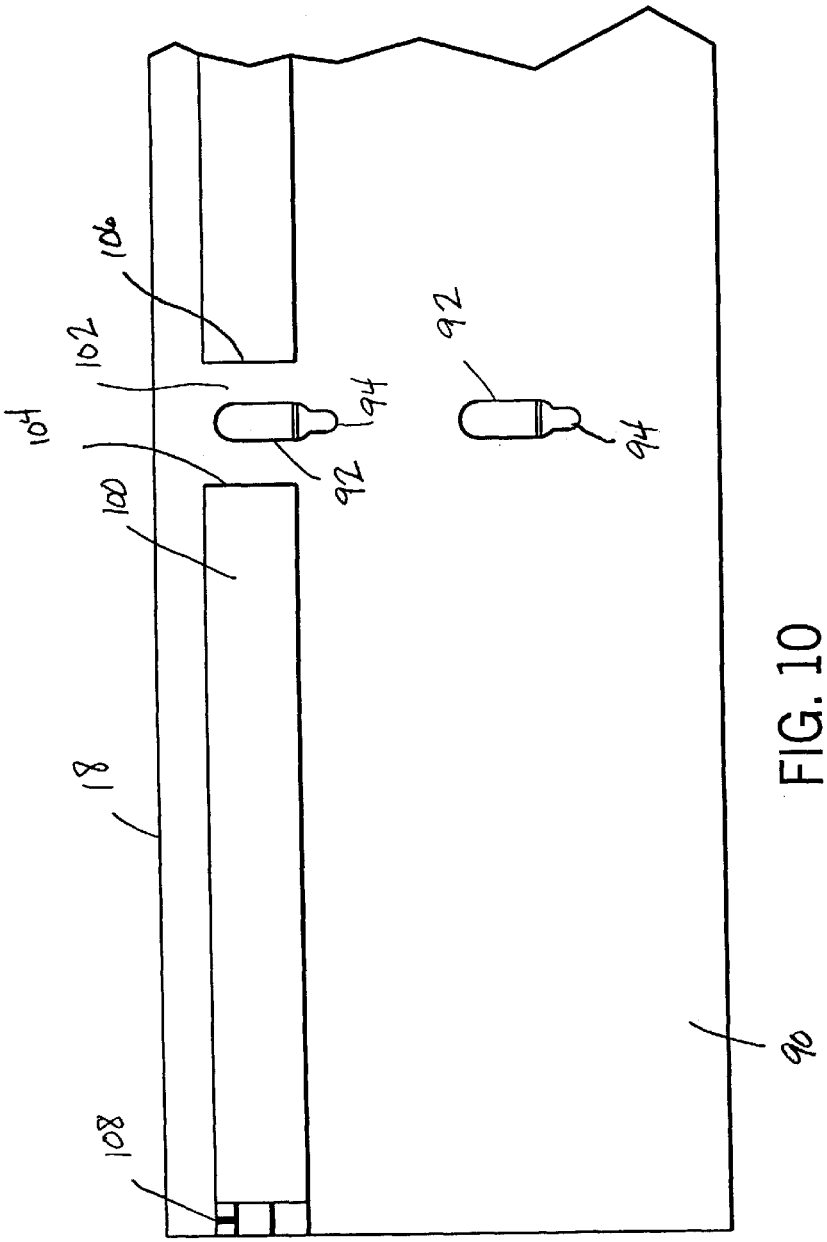
FIG. 10 is a magnified view of the inner face surface of the end rail.

Referring now to FIG. 10, the hanger 32 can be attached to the inside face 90 of one of the end rails 18 through the interaction between the mounting tabs 84 and a pair of aligned hanger notches 92. A pair of hanger notches 92 are spaced from each other by a distance corresponding to the spacing between the pair of mounting tabs 84 formed on the back wall 80 of the hanger 32. The hanger 32 is attached to the end rail 18 by inserting the pair of mounting tabs 84 into the aligned hanger notches 92. Once the mounting tabs have been inserted, the hanger is moved downward until the standoff 88 contacts the reduced diameter bottom edge 94 of each hanger notch 92. When in this position, the lower edge 86 of each mounting tab 84 prevents the hanger from being pulled off of the inside face 90 of the end rail 18.

Figure 12:
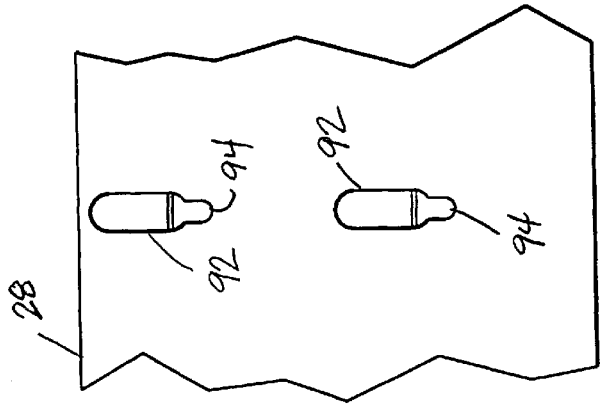
FIG. 12 is a front view of the face surface of the center beam.

As illustrated in FIG. 2, the hangers 32 are also attached to both face surfaces of the center beam 28. FIG. 12 illustrates a corresponding pair of hanger notches 92 formed in the outer face surface of the center beam 28. The hanger notches 92 again provide a point of attachment for the hanger to the center beam 28.

Figure 11:
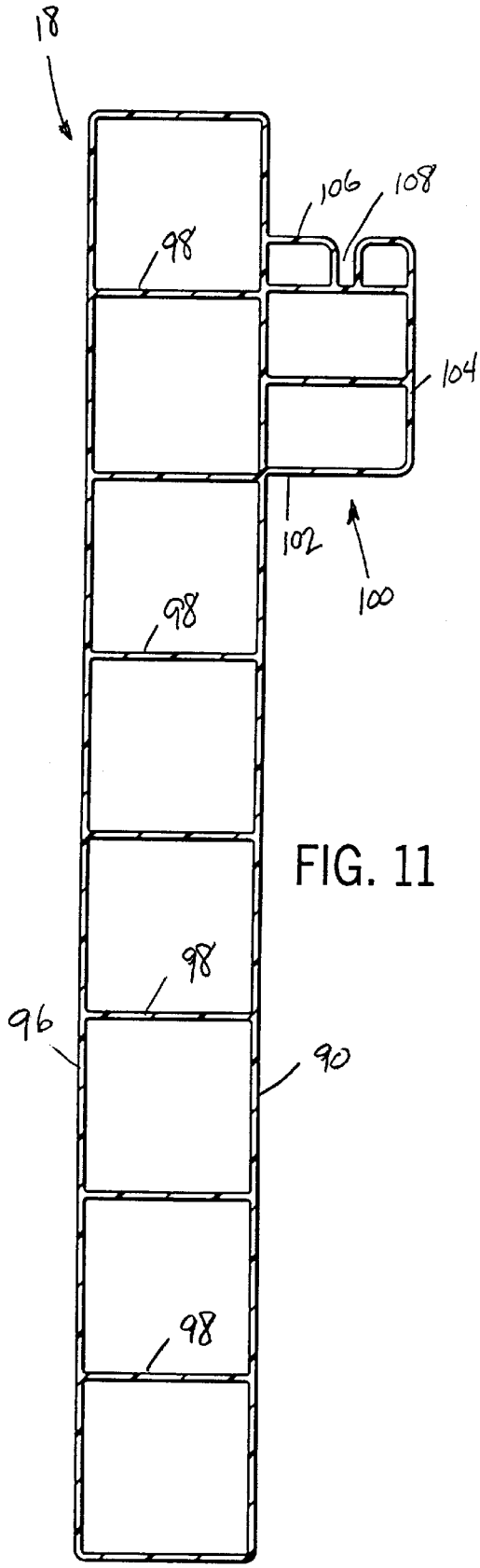
FIG. 11 is a section view of the end rail illustrated in FIG. 10.

Referring now to FIG. 11, thereshown is a cross-section view of one of the end rails 18. Although the cross-section of FIG. 11 is of the end rail 18, it should be understood that the cross-section is identical for each of the side boards 24. As illustrated in FIG. 11, the end rail 18 includes an inside face surface 90 and an outside face surface 96 to define the width of the end rail 18. The open interior of the end rail 18 includes a plurality of internal support walls 98 that provide the required stability and strength for the end rail 18. Since the end rail 18 is an extruded plastic component, the support walls 98 are formed integrally with the inside face surface 90 and the outside face surface 96 of the end rail 18.

As illustrated in FIG. 11, the end rail 18 includes a support section 100 that extends away from the inside face surface 90. The support section 100 generally includes a bottom wall 102, a sidewall 104 and a top wall 106. The top wall 106 includes a recessed mounting slot 108. As illustrated in FIG. 11, the support section 100 is molded integrally with the remaining portions of the end rail 18.

Referring back to FIG. 10, the support section 100 is removed in area 102 between a first edge 104 and a second edge 106. The space between the first edge 104 and the second edge 106 defines an opening to receive one of the hangers 32. In addition, the support section 100 includes a beveled end 108 that creates the corners between the end rail 18 and one of the side boards 24. Preferably, the end 108 is beveled at 45° to provide a clean corner when the bed frame is assembled.

Figure 13:
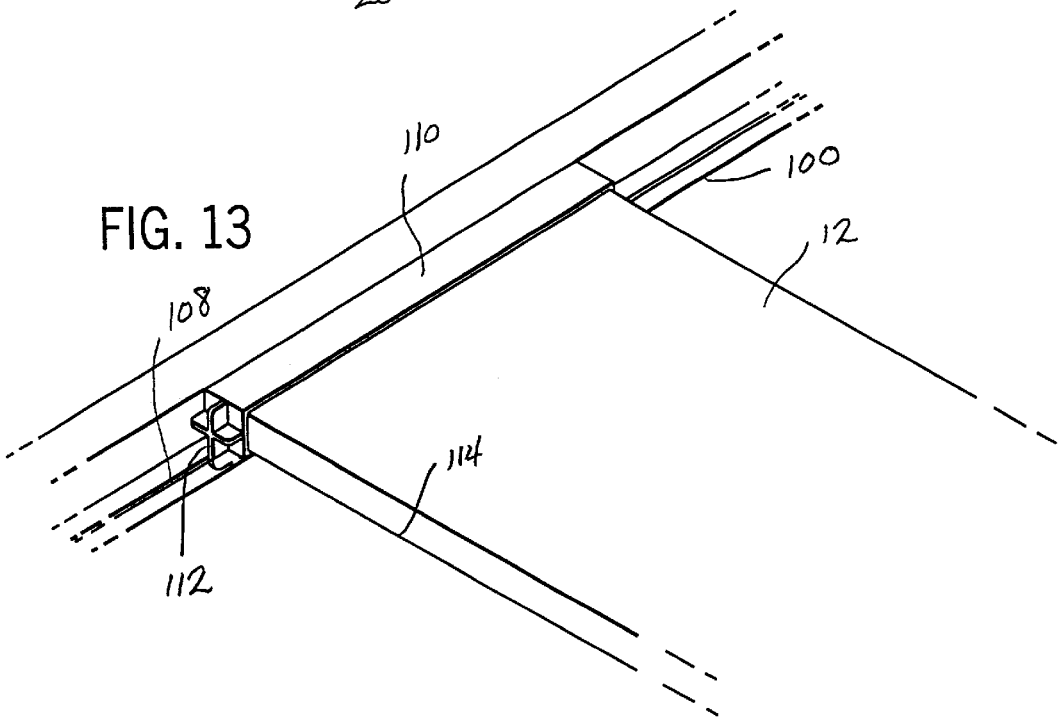
FIG. 13 is a perspective view illustrating one of the top panels and its corresponding end bracket supported along the support section of one of the side rails.

Referring now to FIG. 13, each of the top panels 12 is an extruded plastic component that is received within an end cap 110. The end cap 110 is a molded plastic component sized to be installed on each end of the top panel 12. The end cap 110 includes a bottom ridge 112 that extends below the bottom face surface 114 of the top panel 12. The bottom ridge 112 is received within the mounting slot 108 formed in the support section 100. As can be understood in FIGS. 1 and 2, the top panels are thus supported across the width of the bed frame 14 between the pair of spaced side rails 16. The interaction between the bottom ridge 112 and the mounting slot 108 allows the top panels 12 to be slid along the length of the side rails 16 such that the bed frame assembly can be easily set up and taken down.

As can be understood by the foregoing description, the entire bed frame assembly of the present invention is formed entirely from plastic such that the bed frame assembly 10 is lightweight, durable and inexpensive to manufacture. Further, the entire bed frame assembly can be disassembled into its various components such that the entire bed frame assembly can be contained within a standard shipping container. Further, it can be appreciated by the foregoing description that the entire bed assembly can be assembled land disassembled without the use of any additional tooling. The bed frame assembly of the present invention thus allows for easy set up and take down while being readily transportable.

Various alternatives and embodiments are contemplated as being within the scope of the following claims particularly pointing out and distinctly claiming the subject matter regarded as the invention.

I claim:

1. The bed frame assembly for supporting a mattress, the bed frame assembly comprising:

a pair of side rails each being formed from extruded plastic, each side rail being formed from at least two side boards joined to each other by a plastic connector bracket, wherein each connector bracket includes a pair of side openings sized to receive an end of one of the side boards, wherein the connector bracket includes a pair of locking tabs that each extend into one of the side openings to engage the side board received in the side openings;

a pair of end rails removably connectable between the side rails to form a generally rectangular bed frame, the end rails being formed from extruded plastic; and a plurality of top panels positionable between the side rails to define a top support surface to support the mattress, the top panels being formed from extruded plastic.

2. The bed frame assembly of claim 1 further comprising a center beam extending across the bed frame, the center beam having a first end and a second end, wherein the first and second ends of the center beam are received by the pair of connector brackets.

3. The bed frame assembly of claim 2 wherein each connector bracket includes a center channel sized to receive one end of the center beam.

4. The bed frame assembly of claim 3 wherein the connector bracket includes a pair of locking pins positioned on opposite sides of the center channel, wherein the locking pins are each received in a slot formed in the center beam to hold the center beam in the center channel.

5. The bed frame assembly of claim 2 further comprising a plurality of joists each positionable between the center beam and one of the end rails, wherein each joist is formed from extruded plastic.

6. The bed frame assembly of claim 5 further comprising a plurality of hangers removably attachable to the end rails and the center beam, wherein the plurality of joists are supported on each end by one of the hangers.

7. A bed frame assembly for supporting a mattress, the bed frame assembly comprising:

a pair of side rails, each side rail being formed from extruded plastic;

a pair of end rails removably connectable between the side rails to form a generally rectangular bed frame, the end rails being formed from extruded plastic; and a plurality of top panels positionable between the side rails to define a top support surface to support the mattress, the top panels being formed from extruded plastic, wherein each side rail includes a support section formed along an inside face of the side rail, the support section being integrally formed with the side rail and configured to support the top panels on the bed frame, wherein each top panel includes an end cap positioned on each end of the top panel, the end cap having a bottom ridge that is receivable in a mounting slot formed in the support section of the side rail.

8. A bed frame assembly for supporting a mattress, the bed frame assembly comprising:

a pair of spaced side rails, each side rail being formed from at least two side boards joined to each other by a connector bracket, wherein each of the side boards is formed from extruded plastic, each of the side boards further including a support section formed along the inside face of the side board;

a pair of end rails removably connectable between the side rails to form a generally rectangular bed frame, the end rails being formed from extruded plastic; and a plurality of top panels positionable between the side rails to define a top surface to support the mattress, each top panel having a first end and a second end, wherein both the first end and the second end of each top panel is in contact with the support section formed on the side boards, wherein each of the top panels is formed from extruded plastic.

9. The bed frame assembly of claim 8 further comprising a center beam positionable across the bed frame between the pair of side rails, wherein the center beam includes a first end receivable within one of the connector brackets and a second end receivable within the opposite connector bracket, the center beam being formed from extruded plastic.

10. The bed frame assembly of claim 9 wherein each connector bracket includes a center channel sized to receive one end of the center beam.

11. The bed frame assembly of claim 10 wherein the connector bracket includes a pair of locking pins positioned on opposite sides of the center channel, wherein the locking pins are each received in a slot formed in the center beam to hold the center beam in the center channel.

12. The bed frame assembly of claim 10 further comprising a plurality of joists each positionable between the center beam and one of the end rails, wherein each joist is formed from extruded plastic.

13. The bed frame assembly of claim 12 further comprising a plurality of hangers removably attachable to the end rails and the center beam, wherein the plurality of joists are supported on each end by one of the hangers.

14. The bed frame assembly of claim 8 wherein each top panel includes an end cap positioned on each end of the top panel, the end cap having a bottom ridge that is receivable in a mounting slot formed in the support section of the side rail.

* * * * *